US008096091B2

(12) United States Patent
Cristina

(10) Patent No.: US 8,096,091 B2
(45) Date of Patent: Jan. 17, 2012

(54) PLANK PRECISION SPACING DEVICE

(76) Inventor: James Cristina, Milwaukee, WI (US)

( * ) Notice: Subject to any disclaimer, the term of this patent is extended or adjusted under 35 U.S.C. 154(b) by 59 days.

(21) Appl. No.: 12/719,305

(22) Filed: Mar. 8, 2010

(65) Prior Publication Data

US 2010/0229488 A1 Sep. 16, 2010

Related U.S. Application Data

(60) Provisional application No. 61/209,700, filed on Mar. 10, 2009.

(51) Int. Cl.
*E04D 1/34* (2006.01)

(52) U.S. Cl. ..... 52/551; 52/478; 52/506.05; 52/543; 52/547; 52/548

(58) Field of Classification Search ..... 52/506.05, 52/543, 547, 548, 551, 747.1, 748.1
See application file for complete search history.

(56) References Cited

U.S. PATENT DOCUMENTS 3,903,670 A * 9/1975 Robinson, Jr. ..... 52/478
3,969,866 A * 7/1976 Kyne ..... 52/588.1
4,288,958 A * 9/1981 Chalmers et al. ..... 52/478
5,606,835 A * 3/1997 Champagne ..... 52/545
5,806,185 A * 9/1998 King ..... 29/897.32
6,044,609 A * 4/2000 Kim ..... 52/551
6,223,492 B1 * 5/2001 Barnhart et al. ..... 52/551
6,315,489 B1 * 11/2001 Watanabe ..... 403/381
6,725,618 B2 * 4/2004 Albracht ..... 52/489.1
6,843,032 B2 1/2005 Hikai
7,020,976 B2 4/2006 Just
7,478,507 B2 * 1/2009 Krause ..... 52/546
7,546,692 B2 * 6/2009 Simko ..... 33/647
7,591,115 B2 * 9/2009 Morris ..... 52/546
7,956,790 B2 * 6/2011 Chmelar et al. ..... 341/158

OTHER PUBLICATIONS http://www.siding-tool.com/; SideArm P.O. Box 32, Dollar Bay, MI 49922.

* cited by examiner

*Primary Examiner* — William V Gilbert
*Assistant Examiner* — Gisele Ford
(74) *Attorney, Agent, or Firm* — Absolute Technology Law Group, LLC

(57) ABSTRACT

The present invention is a plank precision spacing device comprised of a sheet component and a pluralty of clamp components with a flattened upper surface perpendicular to the sheet component, and a gripping component and protuberances which engage siding planks. The clamp component further includes a lip which is angled outward. The plank precision spacing device eliminates the need to measure and chalk a line for each siding plank, reducing installation time and labor costs.

12 Claims, 4 Drawing Sheets

PLANK PRECISION SPACING DEVICE

CROSS-REFERENCE TO RELATED APPLICATIONS

This application claims priority to U.S. Provisional Application No. 61/209,700 filed on Mar. 10, 2009.

FIELD OF INVENTION

The present invention relates to the field of siding installation and more particularly to a plank precision spacing and holding device.

GLOSSARY

Figure 1:
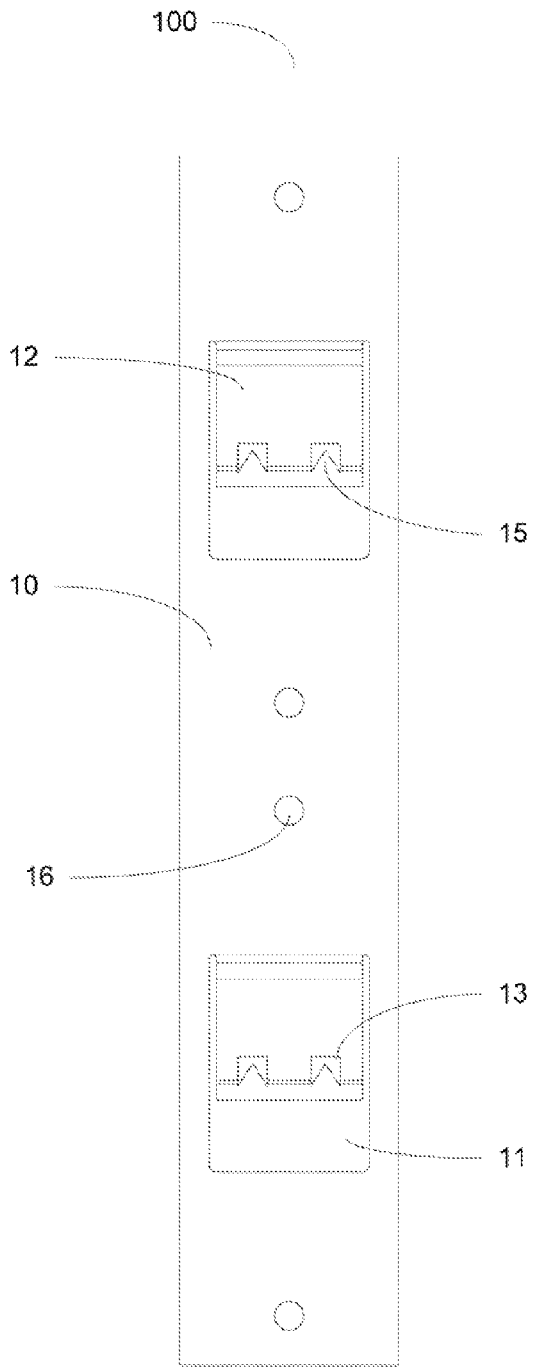
FIG. 1 illustrates a front view of an exemplary embodiment of a plank precision spacing device.

As used herein, the term "lap siding" or "siding" refers to non-vinyl boards or planks having a uniform thickness used for covering the exterior walls of a frame building. Lap siding may be comprised of wood, cement, fiber-cement, engineered wood products, composites or other materials.

As used herein, the terms "plank," "board" or "panel" refer to a piece of lap siding.

As used herein, the term "reveal" refers to vertical width of each piece of siding that is exposed when the siding is installed.

As used herein, the term "plank length" refers to the horizontal distance between the edges of a piece of siding.

As used herein, the term "plank width" refers to the vertical distance between the edges of a piece of siding.

As used herein, the term "lip angle" refers to the angle between the gripping component and the lip of a clamp component.

As used herein, the term "protuberance angle" refers to the angle between a gripping component and the protuberance of a clamp component.

As used herein, the term "permanently mounted" refers to a component that once secured to another object, is not subsequently removed.

BACKGROUND

Vinyl siding is generally used for homes and other buildings, and is a lightweight, easily installed material that lasts 10-30 years, depending on the elements. Vinyl siding, however, has several drawbacks. First, vinyl siding weathers quickly and it is difficult to match damaged, worn, or faded sections of siding for replacement. Vinyl also has a synthetic appearance that is visually different from wood siding. In addition, vinyl siding is also relatively temperature sensitive expanding and contracting as the temperature changes. Vinyl siding may even crack in cold weather.

Aluminum siding is also common, but has a distinctive synthetic or metallic appearance markedly different from natural wood. Aluminum is also a costly product.

Lap siding (e.g., wood and cement siding) is a highly desirable siding product because it has an appearance that can aesthetically mimic that of natural wood and other natural housing materials. Lap siding is also less temperature sensitive than vinyl and the cost of the material itself is on par with the cost vinyl siding.

Although many consumers would prefer cement lap siding, because of its weight, cement lap siding is far more labor intensive and costly to install. Because of the weight of cement lap siding, at least two people must install it, doubling or tripling labor costs.

With both vinyl and cement lap siding, planks of lap siding have to be secured so that they are level on a horizontal plane and at an angle sufficient to overlap with a lower, previously installed plank. Each overlapping plank must be positioned so that the siding has a constant reveal (e.g., visible vertical width when installed) which requires careful measuring and leveling before the placement of each plank.

Typically, the task of installing lap siding requires three individuals. Due to the length (e.g., 12 feet) of the planks, two individuals are necessary to carry and hold the plank steady and level while a third individual secures the plank to the wall studs. The plank needs to be supported at multiple places during the installation process to prevent snapping of the plank.

To install lap siding, planks are applied horizontally starting from the bottom and each subsequent plank is manually placed so that it overlaps the previously placed plank. To install the bottom plank, a line is chalked to indicate placement of the top of the bottom plank, the top of the plank is then aligned with the chalk line and nails or screws are driven into the plank approximately every 6 inches depending on the placement of studs. The plank must be held steady while it is secured to the wall, which typically requires 2 to 3 individuals depending on the length and weight of the plank.

For the placement of the next plank, the installers must measure to ensure the appropriate amount of reveal and overhang and then chalk another line. The placement of each plank must be measured and a line must be chalked prior to the placement of each plank to ensure that each plank is installed level and with the correct amount of reveal and overhang.

Many attempts have been made to reduce the number of individuals and time required to install siding, as well as to simplify the installation process. For example, U.S. Pat. No. 4,288,958 (Chalmers '958) teaches the use of vertical "stringers," positioned 16 to 24 inches apart, to install siding panels. A stringer is a rectangular structural component used with siding, generally made of vinyl.

Figure 2:
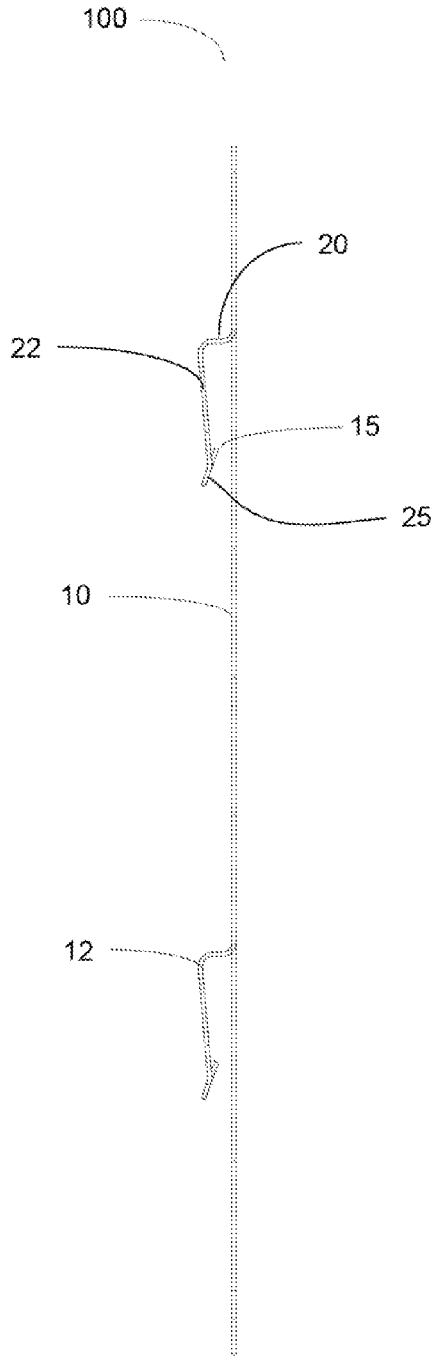
FIG. 2 illustrates a side view of an exemplary embodiment of a plank precision spacing device.

FIG. 2 of Chalmers '958 illustrates a typical vertical stringer. The vertical stringer has upper and lower contoured portions which correspond to the contours on the top and bottom of a panel of vinyl siding and are used to lock the vinyl siding into place. The center of vertical stringer includes a tab, which has no function other than enabling the vertical stringer to be used with a second type of vinyl panel. The vertical stringers illustrated in Chalmers '958 may be used only in conjunction with vinyl panels having corresponding contours. In addition, it cannot be adapted for use with heavier siding, such as lap siding.

Other siding installation aids require that the device be secured to a wall using nails or another fastener and then removed once the piece of siding has been installed. Removing the siding installation device leaves holes in the wall which is structurally undesirable.

Generally, installation siding aids are marketed toward homeowners who want to install siding themselves, not toward contractors, and are not designed to speed of the process of installing siding.

It is desirable to have a siding installation device which is secured to the exterior of a building before installing the siding and is not removed once the siding has been installed.

It is further desirable to have a siding installation device which allows an individual to install multiple horizontal rows of siding with a single placement of the device(s).

It is further desirable to have a siding installation device which decreases the amount of time required to install siding.

SUMMARY OF THE INVENTION

The present invention is a plank precision spacing device comprised of a sheet component and a pluralty of clamp components with a flattened upper surface perpendicular to the sheet component, and a gripping component and protuberances which engage siding planks. The clamp component further includes a lip which is angled outward.

The plank precision spacing device eliminates the need to measure and chalk a line for the placement of each siding plank, reducing installation time and labor costs. In addition, plank precision spacing device allows the installer to have a free hand to stabilize themselves on scaffolding, ladders or other equipment.

DETAILED DESCRIPTION OF INVENTION

For the purpose of promoting an understanding of the present invention, references are made in the text to exemplary embodiments of a plank precision spacing device, only some of which are described herein. It should be understood that no limitations on the scope of the invention are intended by describing these exemplary embodiments. One of ordinary skill in the art will readily appreciate that alternate but functionally equivalent materials, dimensions and designs may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 illustrates a front view of an exemplary embodiment of plank precision spacing device 100 which includes a plurality of clamp components 12 for supporting and holding planks of lap siding. In the embodiment shown, clamp components 12 have flattened upper surface 20 (FIG. 2), gripping component 22, lip 25, and protuberances 15 which engage siding 30 (not shown), and further includes openings 11, 13.

In the embodiment shown, protuberances 15 are triangular shaped teeth; however, in other embodiments, protuberances 15 be of another shape and/or may have serrated edges for engaging siding 30. In the embodiment shown, protuberances 15 are angled inward toward sheet component 10 with a protuberance angle (i.e., the angle between gripping components 22 and protuberances 15) of approximately 25 degrees. In other embodiments, the protuberance angle may range from 10 to 50 degrees and may be dependent on the type and weight of the lap siding used.

Clamp components 12 hold siding 30 in place with force and/or friction. In various embodiments, the inner surface of gripping component 22 may be further include a material, texture, or contours which provide additional friction and resistance.

In the embodiment shown, plank precision spacing device 100 is manufactured using stamping and is comprised of a semi-flexible stainless steel sheet metal.

In the embodiment shown, clamps components 12 are formed by cutting two perpendicular vertical cuts and a single horizontal cut that connects the bottom of the vertical cuts. Protuberances 15 are formed by cutting out a small portion of stainless steel near the bottom of clamp component 12 resulting in opening 13. The interior portion is then folded up to form clamp component 12. The bottom edge of clamp component 12 is angled outward creating lip 25 (FIG. 2) and positioning protuberances 15 so that they are angled slightly inward. In various embodiments, lip 25 may be of varying dimensions, shapes, configurations, or may be omitted.

In the embodiment shown, the interior angle of clamp component 12 is approximately 85 degrees which helps hold the plank of siding while the installer secures the plank to a wall stud. In other embodiments, the interior of clamp component 12 ranges from 30 to 100 degrees.

In the embodiment shown, gripping components 22 of clamp components 12 extend downward approximately 1 inch and clamp components 12 are spaced approximately 4.25 inches apart to accommodate lap siding having a height of 7.25 which allows for an overlap in excess of the minimum recommendation of 1.25 inches and a 6 inch reveal. In other embodiments, gripping components 22 are shorter or longer and/or the distance between clamp components 12 is smaller or greater to accommodate siding of varying widths including, but not limited to, 6.25, 7.25 and 8.25 inches, and the desired reveal (e.g., 3 or 6 inch) when the siding planks are installed.

In various embodiments, the reveal may range from 2 to 6 inches based on the aesthetic preference of the customer.

In the embodiment shown, plank precision spacing device 100 further includes optional apertures 16 for securing plank precision spacing device 100 to a wall stud using nails, screws or another type of fastener. In other embodiments, plank precision spacing device 100 may have an adhesive backing for securing to a wall stud.

In other embodiments, gripping components 22 of clamp components 12 may further include one or more apertures for placing a fastener (e.g., nail, screw) used to secure siding to a wall stud.

FIG. 2 illustrates a side view of an exemplary embodiment of plank precision spacing device 100. Visible in FIG. 2 are flattened upper surface 20, gripping component 22, protuberances 15 and lip 25 of clamp component 12. FIG. 2 further illustrates the thickness of plank precision spacing device 100.

In the embodiment shown, clamp component 12 has a width of approximately ⅜ inches at its widest point to secure lap siding that is 5/16 inches thick. In other embodiments, the width of clamp component 12 is smaller or greater to accommodate lap siding of varying thicknesses. The thickness of lap siding may vary and alternate embodiments will accommodate any range of commercially available siding thicknesses.

In the embodiment shown, plank precision spacing device 100 has a thickness of approximately of 1/32 inch. In other embodiments, the thickness of plank precision spacing device 100 is smaller or greater than 1/32 inch and may vary depending on factors, such as the weight of the lap siding to be installed and/or the environment in which the siding is to be installed. For example, concrete lap siding may require the use of a thicker plank precision spacing device than wood lap siding, as a result of the additional weight of the siding. A thicker plank precision spacing device may also be more desirable in warm and/or humid environments to accommodate for greater expansion and contraction of the siding.

Figure 3:
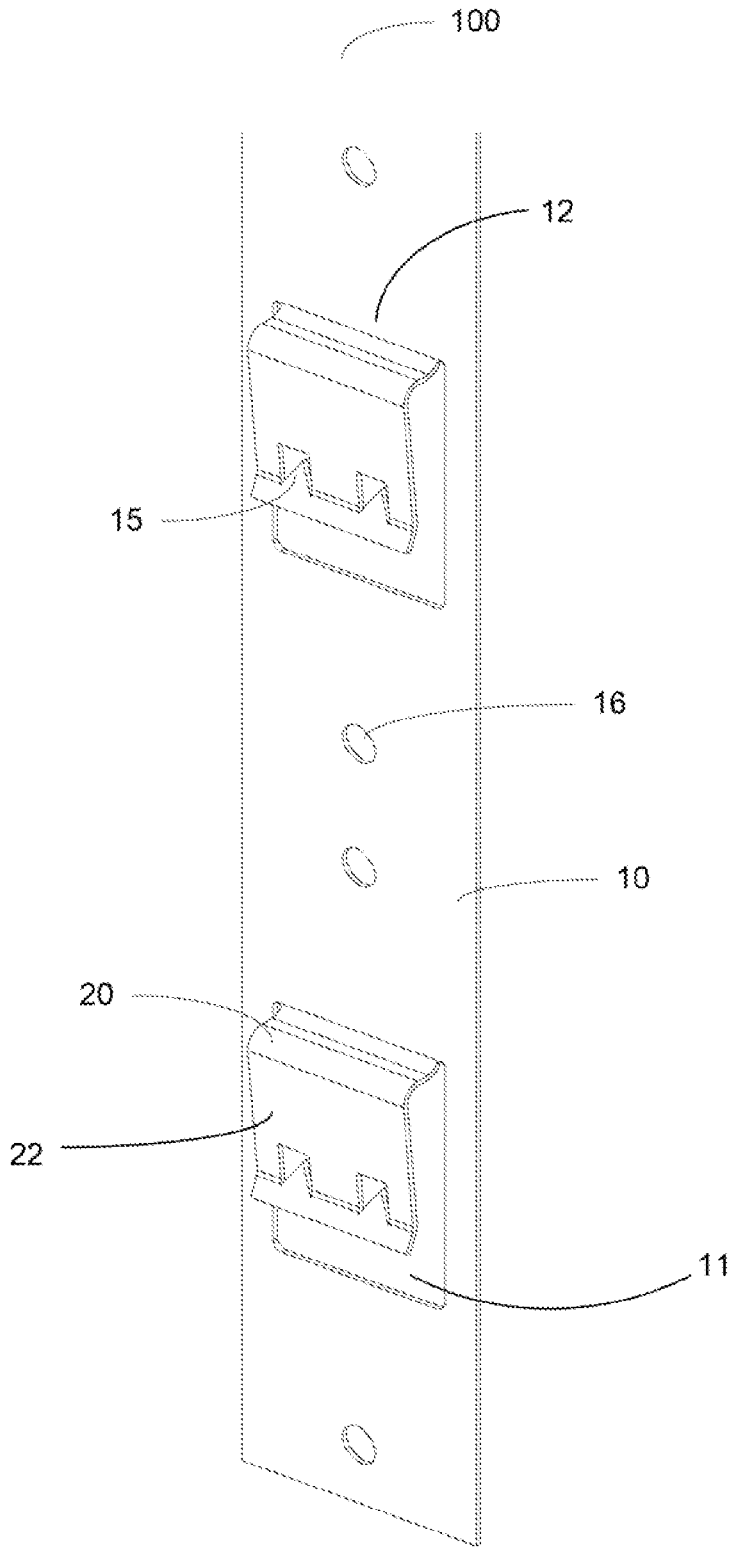
FIG. 3 illustrates a perspective view of an exemplary embodiment of a plank precision spacing device.

FIG. 3 illustrates a perspective view of an exemplary embodiment of plank precision spacing device 100.

Figure 4:
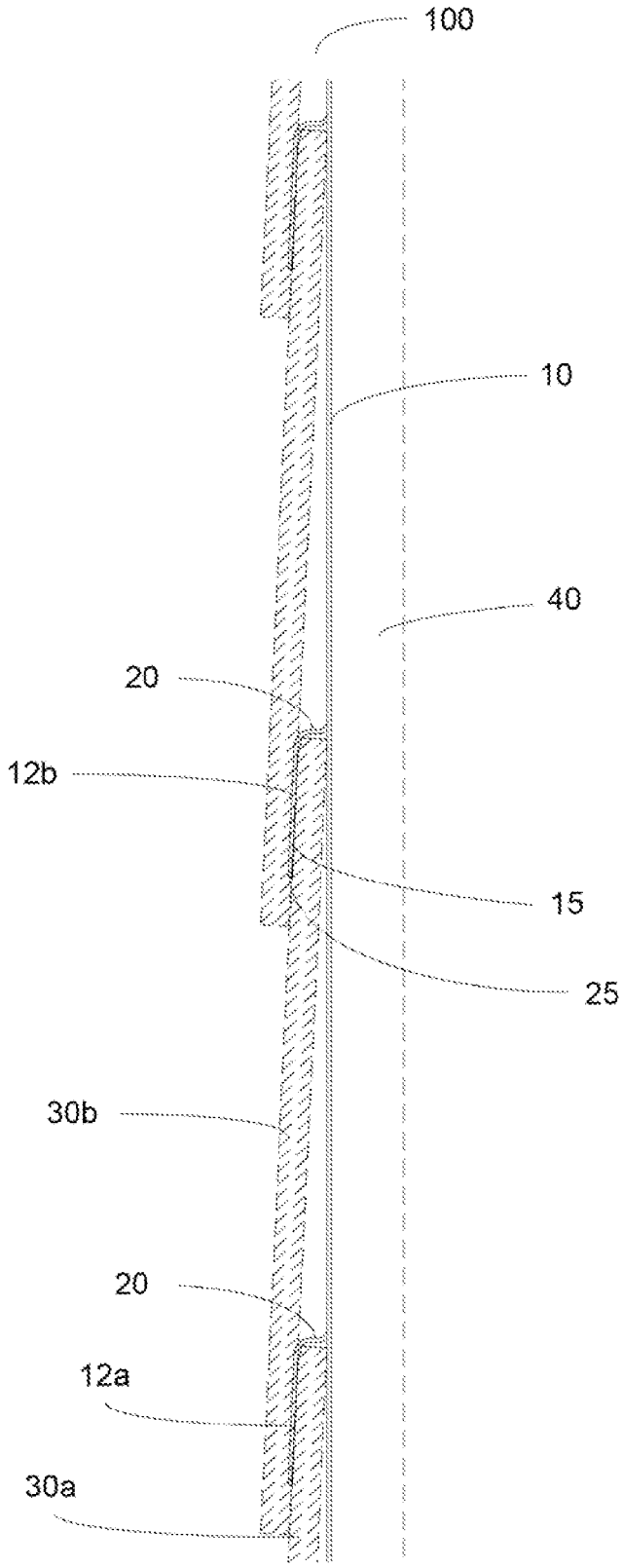
FIG. 4 illustrates a side view of an exemplary embodiment of a plank precision spacing device in use.

FIG. 4 illustrates a side view of an exemplary embodiment of plank precision spacing device 100 in use with siding 30. A line is chalked at the location of the top edge of first plank of siding 30*a* that is to be installed. After first plank of siding 30*a* is properly installed, bottom clamp component 12*a* is slid over the top edge of first plank of siding 30*a* where wall studs 40 are located so that flattened upper surface 20 of clamp component 12*a* contacts the top edge of first plank of siding 30*a*.

In an exemplary embodiment, plank precision spacing devices 100 are secured to wall studs 40 at intervals of approximately 16 inches. In other embodiments, plank precision spacing devices 100 are secured to wall studs 40 at smaller or greater intervals including, but not limited to, intervals of 24 and 32 inches.

Planks of siding 30 are installed horizontally starting from the bottom. When siding 30 is inserted into clamp component 12, gripping component 22 flexes slightly outward to accommodate the thickness of siding 30. Clamp components 12 and protuberances 15 firmly hold siding 30 allowing the installer to secure siding 30 to wall stud 40 without having to hold siding 30.

Once plank precision spacing devices 100 are secured, second plank of siding 30*b* may be inserted into clamp component 12*b*. The weight of siding 30 flattens lip 25 and protuberances 15 so that second plank of siding 30*b* rests tightly against first plank of siding 30*a*. In addition, second plank of siding 30*b* overlaps first plank of siding 30*a* covering the screws, nails or other fasteners used to secure siding 30*a* to wall stud 40. Subsequent planks of siding 30 are installed into all of clamp components 12 are used.

Plank precision spacing device 100 ensures that the siding is installed correctly, that is, with the correct spacing, overlap, and positioning to protect the structure of the building. When plank precision spacing device 100 is used correctly, siding 30 will prevent the elements from damaging the building's structure (e.g., by allowing water to pool behind the siding and cause mold growth).

Plank precision spacing device 100 decreases the amount of time required to install planks of siding 30. Depending on the length of planks of siding 30, 2 to 3 individuals may still be needed to carry and insert planks of siding 30 into clamp components 12. However, once planks of siding 30 have been inserted into clamp components 12, one individual can secure planks of siding 30 to wall studs 40 while the remaining individuals measure, cut and/or retrieve the next plank of siding 30.

In the embodiment shown, plank precision spacing device 100 is 1.5 inches wide, 6 feet long, and has 18 clamp components 12 with approximately 15/16 of sheet component 10 below the first clamp component and above the last clamp component, which allows a second plank precision spacing device 100 to be placed snug against the top edge of first plank precision spacing device 100 (i.e., does not require a second line be chalked).

In various embodiments, plank precision spacing device 100 may be up to 12 feet in length and the width of plank precision spacing device 100 may be as narrow as 0.5 or 0.75 inches as wide as a wall stud (e.g., 4 or 6 inches) and/or may include one or more protuberances 15 scaled to the width of plank precision spacing device 100 and the weight of siding 30.

In various other embodiments, plank precision spacing device 100 may be packaged, sold or distributed in a rolled or coiled form which may be cut to the desired size.

In other embodiments, plank precision spacing device 100 is narrower or wider, shorter or longer (e.g., 4 feet, 8 feet) and/or has a smaller or greater number of clamp components 12 determined by the length of plank precision spacing device 100 as well as the width of siding 30 and the desired reveal. In still other embodiments, the top and bottom edges of plank precision spacing device 100 are notched to facilitate the placing of a second plank precision spacing device above a first.

In the embodiment shown, plank precision spacing device 100 is secured to wall stud 40 by inserting a nail through apertures 16 (not shown) in plank precision spacing device 100. In other embodiments, plank precision spacing device 100 is secured to wall stud 40 using screws, adhesive, or another type of fastener or securing component known in the art.

Figure 5:
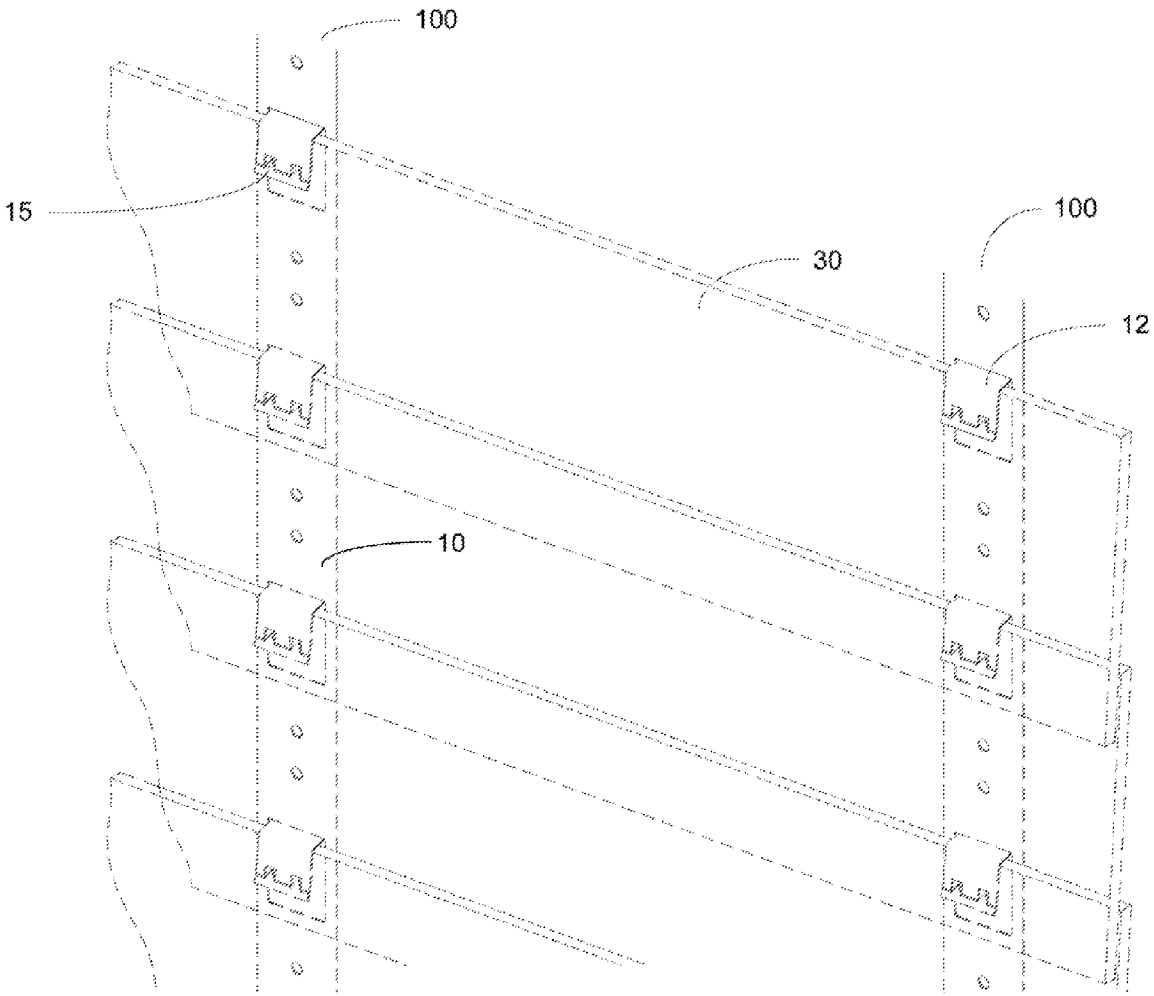
FIG. 5 illustrates a perspective view of an exemplary embodiment of a plank precision spacing device in use.

FIG. 5 illustrates a perspective view of an exemplary embodiment of plank precision spacing device 100 in use with siding 30. In the embodiment shown, plank precision spacing device 100 is 6 feet long and has 18 clamp components 12. After planks of siding 30 have been installed in all 18 clamp components 12, another set of plank precision spacing devices 100 may be secured directly above the existing plank precision spacing devices 100. Once a plank of siding 30 has been installed in the final clamp component 12, the length of plank precision spacing devices 100 which extends vertically beyond the last installed plank of siding 30 is cut or ripped off. The final plank of siding 30 is cut or ripped to the necessary specifications and manually installed. When installed, the final plank of siding 30 covers plank precision spacing device 100 so that it is not visible.

In other embodiments, sheet component 10 further includes a plurality of scored or stamped seams which allow the installer to easily remove the excess portion of plank precision spacing device 100. For example, the seams may be located approximately one inch above each clamp component 12. In still other embodiments, sheet component 10 may further include measurement marks which enable the installer to easily measure the length needed for a particular section.

What is claimed is:

1. A permanently mounted plank precision spacing system comprised of:

a flat sheet component;

a plurality of outwardly bent lap siding clamp components, each of said outwardly bent lap siding clamp components spaced equidistantly along the flat sheet component, said outwardly bent lap siding clamp components having a flattened upper surface, a curved outer gripping component, said curved outer gripping component angled inward towards said flat sheet component;

wherein each of said outwardly bent lap siding clamp components is formed entirely from the surface material of said flat sheet component;

wherein each of said outwardly bent lap siding clamp components further includes an outwardly angled rectangular lip, said outwardly angled rectangular lip further including a pair of inwardly angled triangular shaped teeth bent inward towards said flat sheet component, each of said inwardly angled triangular shaped teeth formed from the material of each of said outwardly bent lap siding components and adapted to engage the surface of at least one plank of lap siding; and wherein said outwardly bent lap siding clamp components are spaced approximately 4.25 inches apart to form overlapping areas with a plank of inserted lap siding, said overlapping areas having a longitudinal spacing of 1.25 to 6 inches, allowing said angled triangular shaped teeth to securely grasp said inserted plank of lap siding.

2. The permanently mounted plank precision spacing device of claim 1 wherein said clamp component further includes an outwardly angled lip.

3. The permanently mounted plank precision spacing device of claim 1 wherein said at least one protuberance is a serrated edge.

4. The permanently mounted plank precision spacing device of claim 1 wherein said sheet component is stamped sheet metal.

5. The permanently mounted plank precision spacing device of claim 1 wherein said sheet component is extruded metal.

6. The permanently mounted plank precision spacing device of claim 1 wherein said sheet is molded from a material selected from a grouping consisting of metals, metal alloys, plastics, ceramics, polymers, fibers, and resins.

7. The permanently mounted plank precision spacing device of claim 1 wherein said sheet component further includes apertures for securing said sheet component to a wall stud.

8. The permanently mounted plank precision spacing device of claim 1 wherein the back of said sheer component further includes adhesive for securing said sheet component to a wall stud.

9. The permanently mounted plank precision spacing device of claim 1 wherein said sheet component is 1.5 inches wide and 6 feet long.

10. The permanently mounted plank precision spacing device of claim 1 wherein said sheet component has a width ranging from 0.5 inches to 4 inches.

11. The permanently mounted plank precision spacing device of claim 1 wherein said plank precision spacing device is packaged in a rolled form cut to the desired size.

12. The permanently mounted plank precision spacing device of claim 1 wherein said at least one protuberance is angled inward to engage and secure siding.

* * * * *